US005200791A

United States Patent [19]

Dastin et al.

[11] Patent Number: 5,200,791

[45] Date of Patent: Apr. 6, 1993

[54] MULTIPLE PITCH COLOR REGISTRATION SYSTEM

[75] Inventors: Richard M. Dastin, Fairport; Kenneth J. Mihalyov, Webster, both of N.Y.

[73] Assignee: Xerox Corporation, Stamford, Conn.

[21] Appl. No.: 749,760

[22] Filed: Aug. 26, 1991

[51] Int. Cl.[5] ..... G03G 15/01

[52] U.S. Cl. ..... 355/326; 355/275; 355/317; 430/44

[58] Field of Search ..... 355/317, 326, 327, 212, 355/275, 204; 430/42, 44

[56] References Cited

U.S. PATENT DOCUMENTS 4,578,331 3/1986 Ikeda et al. .
4,849,795 7/1989 Spehrley, Jr. et al. .
4,935,788 6/1990 Fantuzzo et al. .
4,990,969 2/1991 Rapkin .
5,014,094 5/1991 Amitani et al. .

*Primary Examiner*—A. T. Grimley
*Assistant Examiner*—Shuk Y. Lee
*Attorney, Agent, or Firm*—Oliff & Berridge

[57] ABSTRACT

A multiple pitch color registration system is disclosed for registering two images that are not precisely placed on a photoreceptor in an electrophotographic printing machine. The registration system is able to run asynchronously for a period of time and then to resynchronize in two different pitch modes. A two roll transfer loop for transferring the plurality of colors is phase locked to the photoreceptor position so that the two roll transfer loop follows the photoreceptor motion errors for maintaining accurate registration.

21 Claims, 7 Drawing Sheets

MULTIPLE PITCH COLOR REGISTRATION SYSTEM

BACKGROUND OF THE INVENTION

This invention relates generally to an electrophotographic printing machine, and more particularly concerns a system for registering two images that are not precisely placed in the same location on the photoreceptor of the printing machine. The registration of the system runs asynchronously over a period of time and resynchronizes in two different pitch modes.

The marking engine of an electronic reprographic printing system is frequently an electrophotographic printing machine. In an electrophotographic printing machine, a photoconductive member is charged to a substantially uniform potential to sensitize the surface thereof. The charged portion of the photoconductive member is thereafter selectively exposed. Exposure of the charged photoconductive member dissipates the charge thereon in the irradiated areas. This records an electrostatic latent image on the photoconductive member corresponding to the informational areas contained within the original document being reproduced. After the electrostatic latent image is recorded on the photoconductive member, the latent image is developed by bringing toner into contact therewith. This forms a toner image on the photoconductive member which is subsequently transferred to a copy sheet. The copy sheet is heated to permanently affix the toner image thereto in image configuration.

Multi-color electrophotographic printing is substantially identical to the foregoing process of black and white printing. However, rather than forming a single latent image on the photoconductive surface, successive latent images corresponding to different colors are recorded thereon. Each single color electrostatic latent image is developed with toner of a color complementary thereto. This process is repeated a plurality of cycles for differently colored images and their respective complementarily colored toner. Each single color toner image is transferred to the copy sheet in superimposed registration with the prior toner image. This creates a multi-layered toner image on the copy sheet. Thereafter, the multi-layered toner image is permanently affixed to the copy sheet creating a color copy. The developer material may be a liquid or a powder material.

In the process of black and white printing, the copy sheet is advanced from an input tray to a position inside the electrophotographic printing machine where a toner image is transferred thereto and then to an output catch tray for subsequent removal therefrom by the machine operator. In the process of multi-color printing, the copy sheet moves from an input tray through a recirculating path internal to the printing machine where a plurality of toner images is transferred thereto and then to an output catch tray for subsequent removal. With regard to multi-color printing, a sheet gripper secured to a transport receives the copy sheet and transports it in a recirculating path enabling the plurality of different color images to be transferred thereto. The sheet gripper grips one edge of the copy sheet and moves the sheet in a recirculating path so that accurate multi-pass color registration is achieved. In this way, magenta, cyan, yellow, and black toner images are transferred to the copy sheet in registration with one another.

Because color printing systems generally require four passes of the copy sheet through the transfer station (once per color) precise matching of the copy sheet with the latent image on the photoreceptor is necessary during each pass of the copy sheet through the transfer station. Current color systems, however, consistently image the photoreceptor in the same position, thus insuring uneven wear of the photoreceptor. In addition, the current color systems may be constrained to run in only one pitch mode, thus reducing throughput.

U.S. Pat. No. 4,578,331 to Ikeda et al discloses an electrophotographic color image forming process wherein three light beams, each representing image information of three primary colors to be recorded by color separation, are simultaneously projected and written to the surface of a photosensitive member. The images are then developed by toners of three different colors and are then printed by transfer printing on a transfer printing sheet.

U.S. Pat. No. 4,935,788 to Fantuzzo et al assigned to Xerox Corporation, discloses a multi-color printing system wherein a plurality of different color images are developed on a photoconductive surface, transferred to an intermediate member in superimposed registration with one another and then transferred to a sheet and fused thereto.

U.S. Pat. No, 4,990,969 to Rapkin discloses a method of forming multi-color images wherein a primary imaging member is used to form a series of primary toner images which are transferred to secondary image members, one for each primary color. The images are then transferred back to the primary imaging member in registration prior to being transferred to a receiving sheet.

U.S. Pat. No. 5,014,094 to Amitani discloses a color image forming apparatus that uses four laser beam printing mechanisms as plural image forming mechanisms, each of which has a photosensitive member. An image is formed on each photosensitive member. A transfer sheet is then moved under the printer mechanism where it receives from the photosensitive members, primary color images sequentially and superimposedly, to form one multi-color image.

While the above-mentioned color printing systems allow for the transfer of a plurality of colors to photoreceptors and copy sheets, there continues to be a need for a system for more precisely matching the latent images on the photoreceptor with the copy sheet, particularly if the latent images are not precisely placed on the photoreceptor.

SUMMARY OF THE INVENTION

It is an object of the present invention to provide a color registration system in an electro-photographic printing machine which overcomes the above-noted disadvantages.

It is another object of the present invention to provide a color registration system which does not require the application of the latent image on the photoreceptor in the same position every time.

Still another object of the present invention is to provide an electronic color registration system which allows for printing in more than one pitch mode.

Yet another object of the present invention is to provide a color registration system which allows for the registration of images that are not precisely placed on the photoreceptor, the system capable of running asynchronously over a period of time and resynchronizing in two different pitch modes.

These and other objects of the present invention are achieved by an image registration control system and a color electrophotographic printer which electronically synchronizes a two roll transfer loop with a plurality of latent images on a photoreceptor. The registration control system locks the movement of the two roll transfer loop with the placement of the latent image on the photoreceptor so that the latent image of the photoreceptor need not be placed in exactly the same position each time.

BRIEF DESCRIPTION OF THE DRAWINGS

A more complete understanding can be obtained by reference to the following drawings and description, wherein.

DESCRIPTION OF THE PREFERRED EMBODIMENTS

While the present invention will hereinafter be described in connection with various embodiments thereof, it will be understood that it is not intended to limit the invention to these embodiments. On the contrary, it is intended to cover all alternatives, modifications and equivalents that may be included within the spirit and scope of the invention as defined by the appended claims.

1. The Multi-Color Printing System

Figure 1:
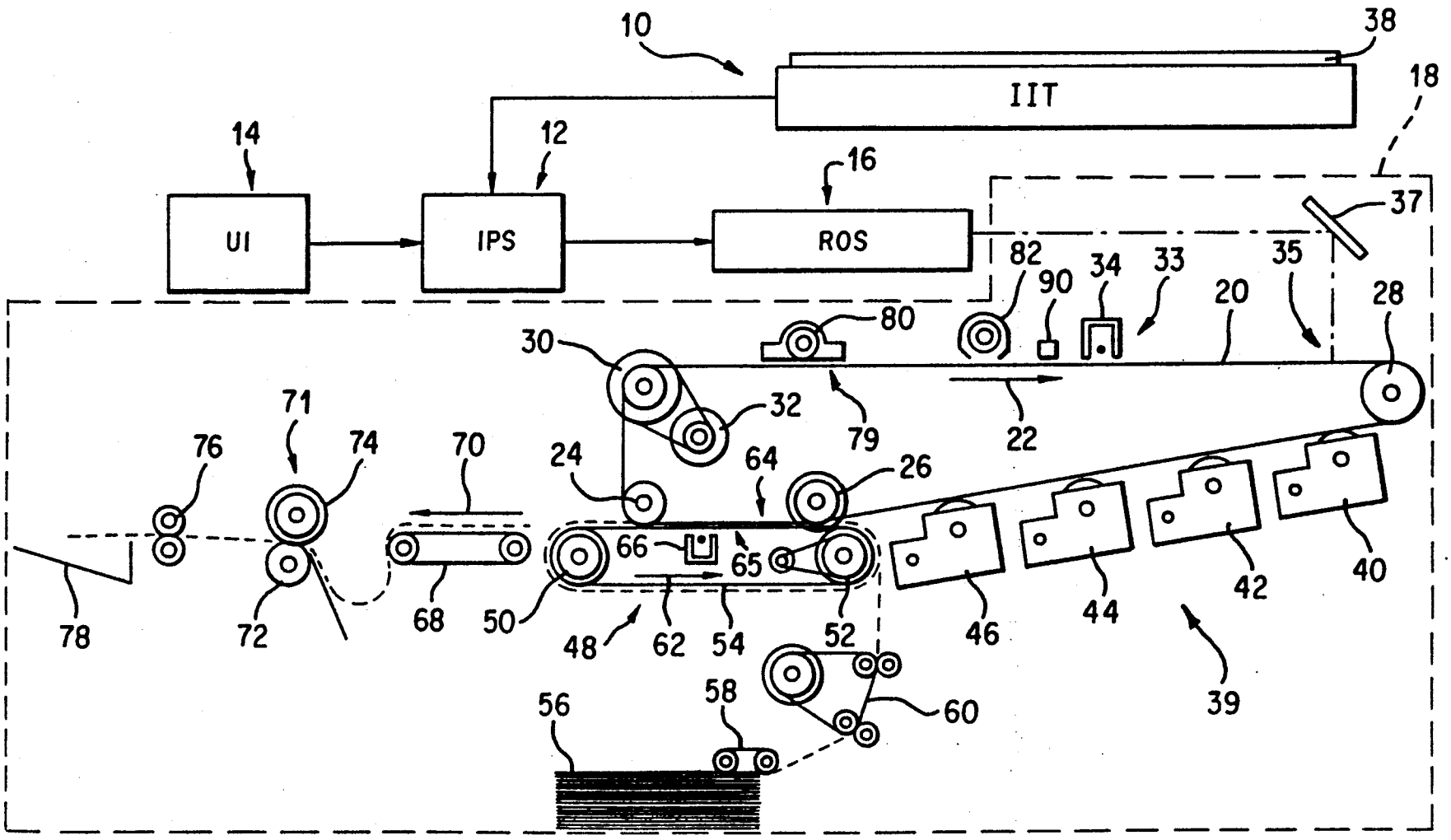
FIG. 1 is a schematic elevational view depicting an electrophotographic printing machine incorporating the sheet transport apparatus of the present invention therein.

Turning initially to FIG. 1, during operation of the printing system, a multi-color original document 38 is positioned on an image input terminal (IIT), indicated generally by the reference numeral 10. The IIT contains document illumination lamps, optics, a mechanical scanning drive, and a charge coupled device (CCD array). The IIT captures the entire original document and converts it to a series of raster scan lines and measures a set of primary color densities, i.e. red, green and blue densities, at each point of the original document. This information is transmitted to an image processing system (IPS), indicated generally by the reference numeral 12. IPS 12 contains control electronics which prepare and manage the image data flow to a raster output scanner (ROS), indicated generally by the reference numeral 16. A user interface (UI), indicated generally by the reference numeral 14, is in communication with IPS 12. UI 14 enables an operator to control the various operator adjustable functions. The output signal from UI 14 is transmitted to IPS 12. A signal corresponding to the desired image is transmitted from IPS 12 to ROS 16, which creates the output copy image. ROS 16 lays out the image in a series of horizontal scan lines with each line having a specified number of pixels per inch. ROS 16 includes a laser having a rotating polygon mirror block associated therewith ROS 16 exposes a charged photoconductive belt 20 of a printer or marking engine, indicated generally by the reference numeral 18, to achieve a set of subtracive primary latent images. The latent images are developed with cyan, magenta, and yellow developer material, respectively. These developed images are transferred to a copy sheet in superimposed registration with one another to form a multi-colored image on the copy sheet. This multi-colored image is then fused to the copy sheet forming a color copy.

With continued reference to FIG. 1, printer or marking engine 18 is an electrophotographic printing machine. Photoconductive belt 20 of marking engine 18 is preferably made from a polychromatic photoinductive material. The photoconductive belt moves in the direction of arrow 22 to advance successive portions of the photoconductive surface sequentially through the various processing stations disposed about the path of movement thereof. Photoconductive belt 20 is entrained about transfer rollers 25 and 26, tensioning roller 28, and drive roller 30. Drive roller 30 is rotated by a motor 32 coupled thereto by suitable means such as a belt drive. As roller 30 rotates, it advances belt 20 in the direction of arrow 22.

Initially, a portion of photoconductive belt 20 passes through a charging station, indicated generally by the reference numeral 33. At charging station 33, a corona generating device 34 charges photoconductive belt 20 to a relatively high, substantially uniform potential.

Next, the charge photoconductive surface is rotated to an exposure station, indicated generally by the reference numeral 35. Exposure station 35 receives a modulated light beam corresponding to information derived by RIS 10 having a multi-colored original document 38 positioned thereat. IIT 10 captures the entire image for the original document 38 and converts it to a series of raster scan lines which are transmitted as electrical signals to IPS 12. The electrical signals from RIS 10 correspond to the red, green and blue densities at each point in the original document. IPS 12 converts the set of red, green and blue density signals, i.e. the set of signals corresponding to the primary color densities of original document 38, to a set of colorimetric coordinates. The operator actuates the appropriate keys of UI 14 to adjust the parameters of the copy. UI 14 may be a touch screen, or any other suitable control panel, providing an operator interface with the system. The output signals from UI 14 are transmitted to IPS 12. The IPS then transmits signals corresponding to the desired images to ROS 16. ROS 16 includes a laser with rotating polygon mirror blocks. Preferably, a nine facet polygon is used. ROS 16 illuminates, via mirror 37, the charged portion of photoconductive belt 20 at a rate of about 400 pixels per inch. The ROS will expose the photoconductive belt to record three latent images. One latent image is adapted to be developed with cyan developer material. Another latent image is adapted to be developed with magenta developer material and the third latent image is adapted to be developed with yellow developer material. The latent images formed by ROS 16 on the photoconductive belt correspond to the signals transmitted from IPS 12.

After the electrostatic latent images have been recorded on photoconductive belt 20, the belt advances such latent images to a development station, indicated generally by the reference numeral 39. The development station includes four individual developer units indicated by reference numerals 40, 42, 44 and 46. The developer units are of a type generally referred to in the art as "magnetic brush development units." Typically, a magnetic brush development system employs a magnetizable developer material including magnetic carrier granules having toner particles adhering triboelectrically thereto. The developer material is continually brought through a directional flux field to form a brush of developer material. The developer material is constantly moving so as to continually provide the brush with fresh developer material. Development is achieved by bringing the brush of developer material into contact with the photoconductive surface.

Developer units 40, 42 and 44 respectively, apply toner particles of a specific color which corresponds to the compliment of the specific color separated electrostatic latent image recorded on the photoconductive surface. The color of each of the toner particles is adapted to absorb light within a preselected spectral region of the electromagnetic wave spectrum. For example, an electrostatic latent image formed by discharging the portions of charge on the photoconductive belt corresponding to the green regions of the original document will record the red and blue portions as areas of relatively high charge density on photoconductive belt 20, while the green areas will be reduced to a voltage level ineffective for development. The charged areas are then made visible by having developer unit 40 apply green absorbing (magenta) toner particles onto the electrostatic latent image recorded on photoconductive belt 20. Similarly, a blue separation is developed by developer unit 42 with blue absorbing (yellow) toner particles, while the red separation is developed by developer unit 44 with red absorbing (cyan) toner particles. Developer unit 46 contains black toner particles and may be used to develop the electrostatic latent image formed from a black and white original document.

Each of the developer units is moved into and out of an operative position. In the operative position, the magnetic brush is closely adjacent the photoconductive belt, while in the non-operative position, the magnetic brush is placed therefrom. In FIG. 1, developer unit 40 is shown in the operative position with developed units 42, 44 and 46 being in the non-operative position. During development of each electrostatic latent image, only one developer unit is in the operative position, the remaining developer units are in the non-operative position. This insures that each electrostatic latent image is developed with toner particles of the appropriate color without commingling.

After development, the toner image is moved to a transfer station, indicated generally by the reference numeral 65. Transfer station 65 includes a transfer zone, generally indicated by reference numeral 64. In transfer zone 64, the toner image is transferred to a sheet of support material, such as plain paper amongst others. At transfer station 65, a sheet transport apparatus, indicated generally by the reference numeral 48, moves the sheet into contact with photoconductive belt 20. Sheet transport 48 has a pair of spaced belts 54 entrained about a pair of substantially cylindrical rollers 50 and 52. A sheet gripper, generally indicated by the reference numeral 84 (FIG. 2), extends between belts 54 and moves in unison therewith. A sheet 25 is advanced from a stack of sheets 56 disposed on a tray. A friction retard feeder 58 advances the uppermost sheet from stack 56 onto a pretransfer transport 60. Transport 60 advances sheet 25 to sheet transport 48. Sheet 25 is advanced by transport 60 in synchronism with the movement of sheet gripper 84. In this way, the leading edge of sheet 25 arrives at a preselected position, i.e. a loading zone, to be received by the open sheet gripper. The sheet gripper then closes securing sheet 25 thereto for movement therewith in a recalculating path. Further details of the sheet transport system will be discussed hereinafter with reference to FIGS. 2–6. As belts 54 move in the direction of arrow 62, the sheet moves into contact with the photoconductive belt, in synchronism with the toner image developed thereon. At transfer zone 64, a corona generating device 66 sprays ions onto the backside of the sheet so as to charge the sheet to the proper magnitude and polarity for attracting the toner image from photoconductive belt 20 thereto. The sheet remains secured to the sheet gripper so as to move in a recirculating path for three cycles. In this way, three different color toner images are transferred to the sheet in superimposed registration with one another. One skilled in the art will appreciate that the sheet may move in a recirculating path for four cycles when under color black removal is used and up to eight cycles when the information on two original document is being merged onto a single copy sheet. Each of the electrostatic latent images recorded on the photoconductive surface is developed with the appropriately colored toner and transferred, in superimposed registration with one another, to the sheet to form the multi-color copy of the colored original document.

After the last transfer operation, the sheet gripper opens and releases the sheet. A conveyor 68 transports the sheet, in the direction of arrow 70, to a fusing station, indicated generally by the reference numeral 71, where the transferred toner image is permanently fused to the sheet. The fusing station includes a heated fuser roll 74 and a pressure roll 72. The sheet passes through the nip defined by fuser roll 74 and pressure roll 72. The toner image contacts fuser roll 74 so as to be affixed to the sheet. Thereafter, the sheet is advanced by a pair of rolls 76 to catch tray 78 for subsequent removal therefrom by the machine operator.

The last processing station in the direction of movement of belt 20, as indicated by arrow 22, is a cleaning station, indicated generally by the reference numeral 79. A rotatably mounted fibrous brush 80 is positioned in the cleaning station and maintained in contact with photoconductive belt 20 to remove residual toner particles remaining after the transfer operation. Thereafter, lamp 82 illuminates photoconductive belt 20 to remove any residual charge remaining thereon prior to the start of the next successive cycle.

Figure 2:
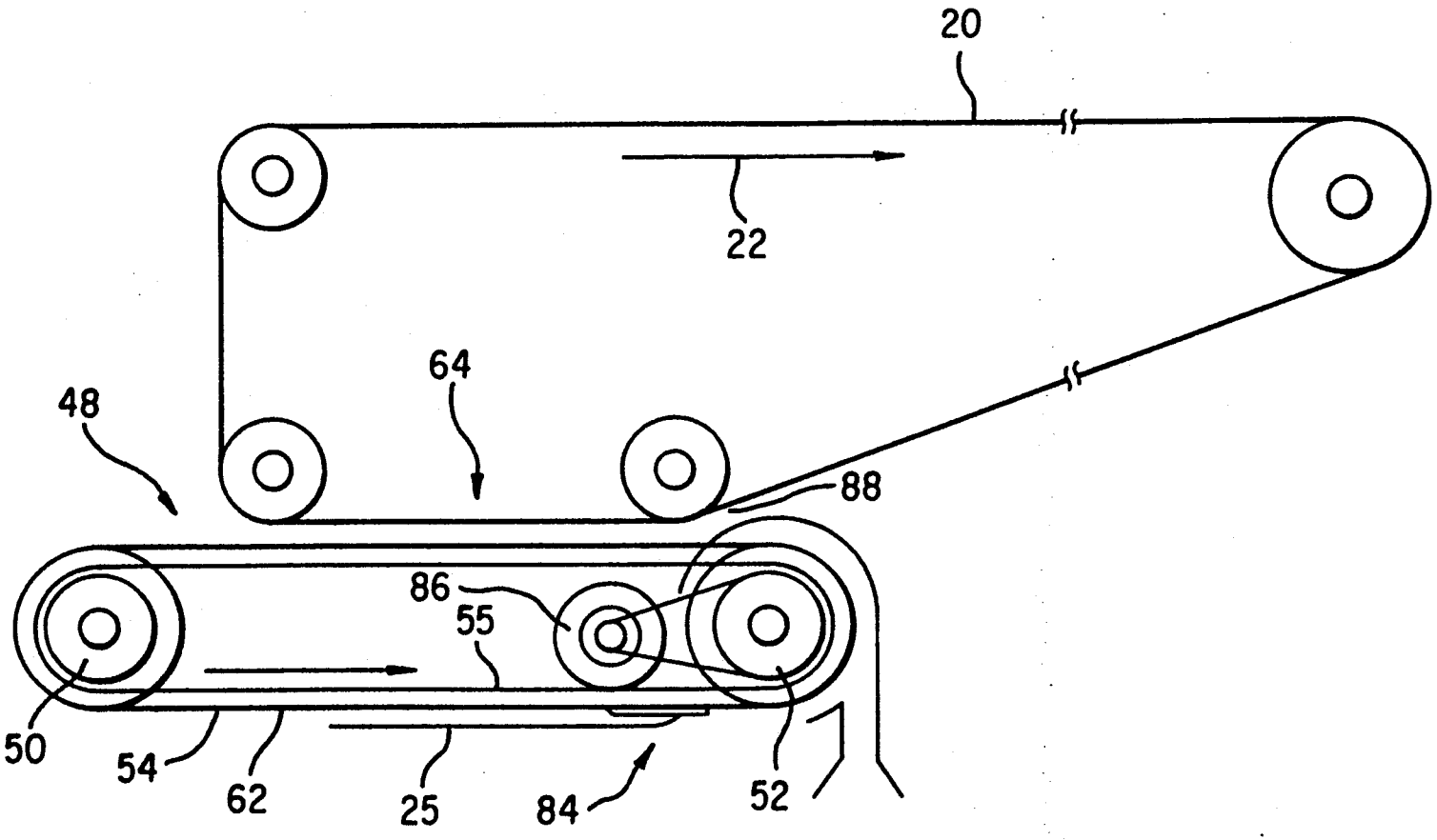
FIG. 2 is a schematic elevational view showing further details of the sheet transport system used in the electrophotographic printing machine of FIG. 1.

FIG. 2 shows sheet gripper 84 of sheet transport 48 transporting sheet 25 in the direction of arrow 62 in a recirculating path of movement. Timing belts 54 are mounted on rollers 50 and 52. Belts 54 define a continuous path of movement of sheet gripper 84. A motor 86 is coupled to roller 52 by a drive belt 88. A pair of spaced apart and continuous tracks 55 are respectively positioned substantially adjacent belts 54. Belts 54 are respectively connected to the opposed side marginal regions of sheet gripper 84. The belts are connected to the sheet gripper behind the leading edge of sheet 25 relative to the forward direction of movement of belts 54, as indicated by arrow 62, when sheet 25 is being transported by sheet transport 48. The sheet gripper is driven by the belts at the locations where the sheet gripper and the belts are connected.

2. The Multiple Pitch Color Registration System

For good copy quality, registration error between all four images should be less than 125 microns. The most common machine architecture which enables the critical color registration requirement in a xerographic machine is to have a photoreceptor drum and a transfer drum which are synchronized mechanically. The drums are typically the same diameter, or one drum is twice the size of the other drum so that color registration is achieved by placing the image on the photoreceptor precisely at the same position for each color so that the transfer drum will meet the developed image precisely at the same position for each color.

There are two disadvantages to such a synchronous registration approach. One disadvantage is that the latent image must always be placed in exactly the same position on the photoreceptor to assure accurate color registration. For any scanner, whether it is a RIS or light/lens, the scan carriage can typically contribute no more than 25 microns of error in determining the lead edge position of the latent image. This is a difficult design challenge. In addition, always imaging in the same position on the photoreceptor decreases photoreceptor life thereby increasing service cost.

Another important disadvantage is the constraint of running the machine in only one pitch mode. Typically these machines are designed to run two main paper sizes, A3 short edge feed (17 inches long), and A4 long edge feed (8.5 inches long). Therefore, the transfer drums are typically designed to be at least 21 inches in circumference to accept a 17 inch long piece of paper, plus 4 inches of intercopy gap to allow flyback time for the scanner and switching time for the developer housings. Since the transfer drum and the photoreceptor are mechanically synchronized, the copies per minute (CPM) for A3 and A4 are at best the same. For A4 long edge feed, approximately 8.5 inches of photoreceptor circumference is being wasted. In fact, some machines skip pitches when running A3 because the intercopy gap is not large enough to allow enough time for the scanner to return home in time for the next scan. The transfer drum therefore makes seven passes to make a four pass color copy. In those machines which are mechanically synchronous, the only way to increase the CPM is to increase the process speed or to design a smaller transfer drum that can handle only 8.5 inch copy paper.

The present invention overcomes the above two constraints by being able to register two images that are not precisely placed on the photoreceptor and by being able to run asynchronously for a period of time and then to resynchronize in two different pitch modes. The present invention can be electronically synchronized in two different pitch modes at low cost.

Figure 3:
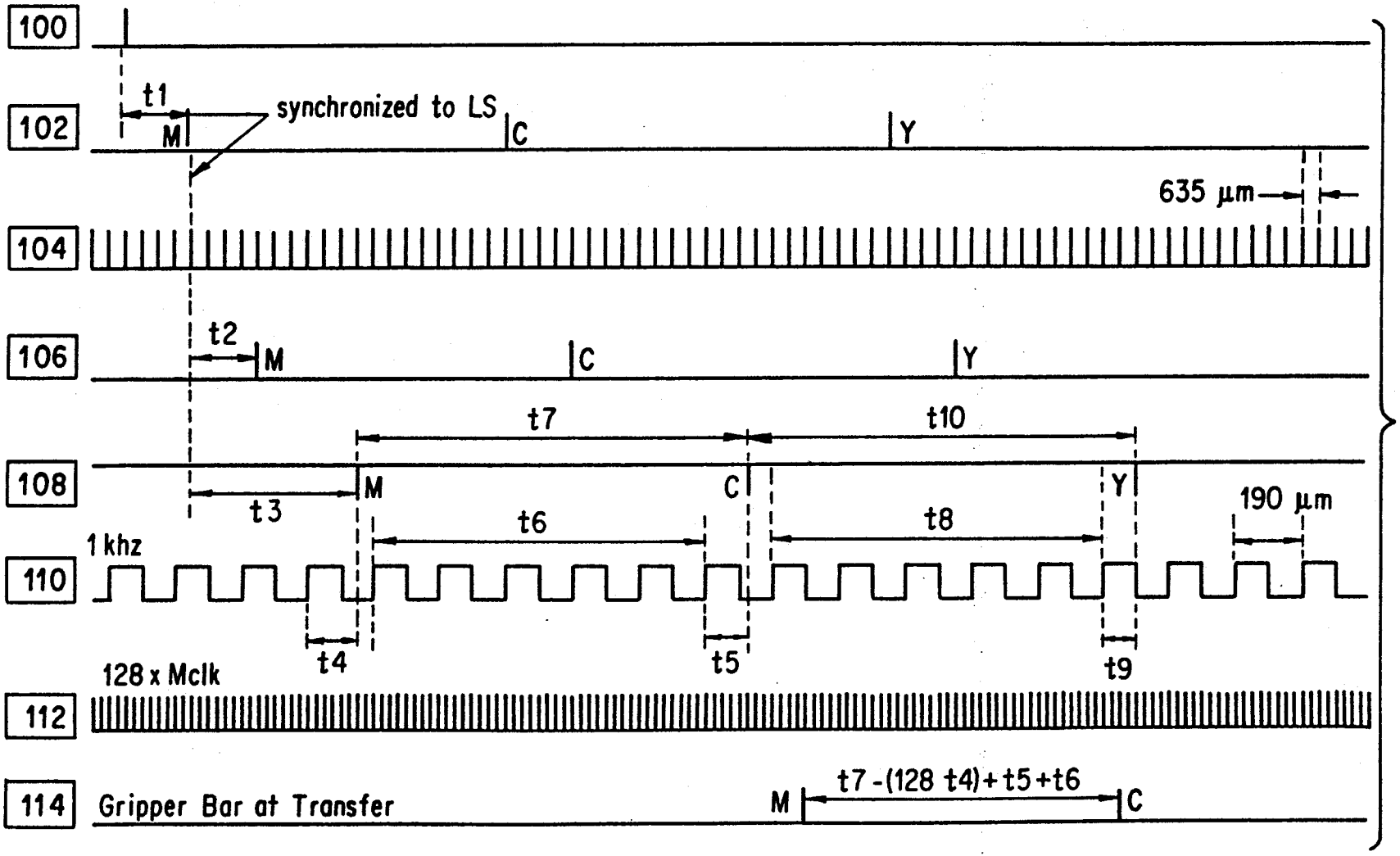
FIG. 3 is a synchronization timing diagram for the present invention.
Figure 4:
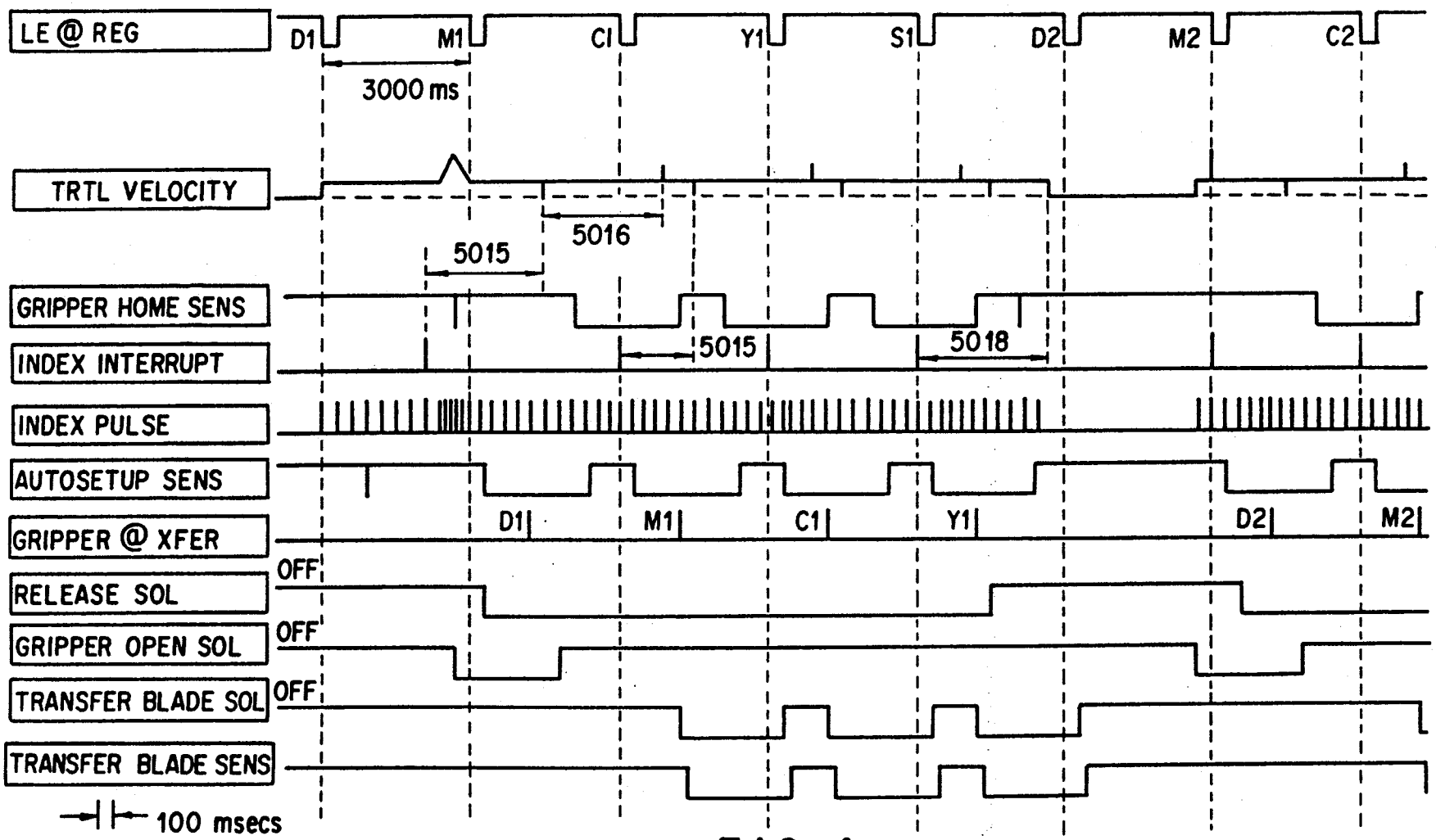
FIG. 4 depicts a two roll transfer loop timing diagram for a three pass, two pitch mode.

The electronic synchronization system is shown in FIG. 3. The imaging process starts with the generation of a belt hole signal 100 which comes from the belt hole sensor 90 located on the photoreceptor module. The belt hole signal 100 is an electronic reference marker once per photoreceptor revolution which tells the control system where the belt seam on the photoreceptor is located. If an image is printed on the belt seam, an undesirable line would be transferred to the copy paper causing an undesirable copy quality defect. Therefore, the image placement on the photoreceptor is constantly being corrected to avoid printing on the seam. From the belt hole signal 100, another electronic marker is generated called pitch reset 102 which is used to partition the belt into 2 segments (2 pitch mode is used for A3 SEF copy paper, see FIG. 4) or 3 segments (3 pitch mode is used for A4 LEF copy paper, see FIG. 5). The pitch reset 102 is generated by the MCB 400 (master control board, see FIG. 6) and is sent to the IIT. The IIT uses the pitch reset 102 to generate reference time (t2) to start the scan carriage 106. Reference time t2 is measured by counting IOT line synchs 104, between the pitch reset and the startof scan signal. Start of scan is a signal generated from the ROS which determines when the next scan line is being printed. 400 spots per inch can be printed so that each scan line is separated by 63.5 microns.

The IIT is driven by an open loop stepper motor which synchronizes itself to the IOT line synch signal. It is important that time t2 is counted in IOT line synchs to guarantee that the scan carriage is positioned in the same place for each scan. Time t3 is also counted in line synchs which is the time from pitch reset to the time when the scanner arrives at the lead edge of the original, which is called LE@REG (Lead Edge Registration, 108). Time t3 will change as a function of magnification, but for the same magnification, t3 must always be the same number of line synchs.

Figure 7:
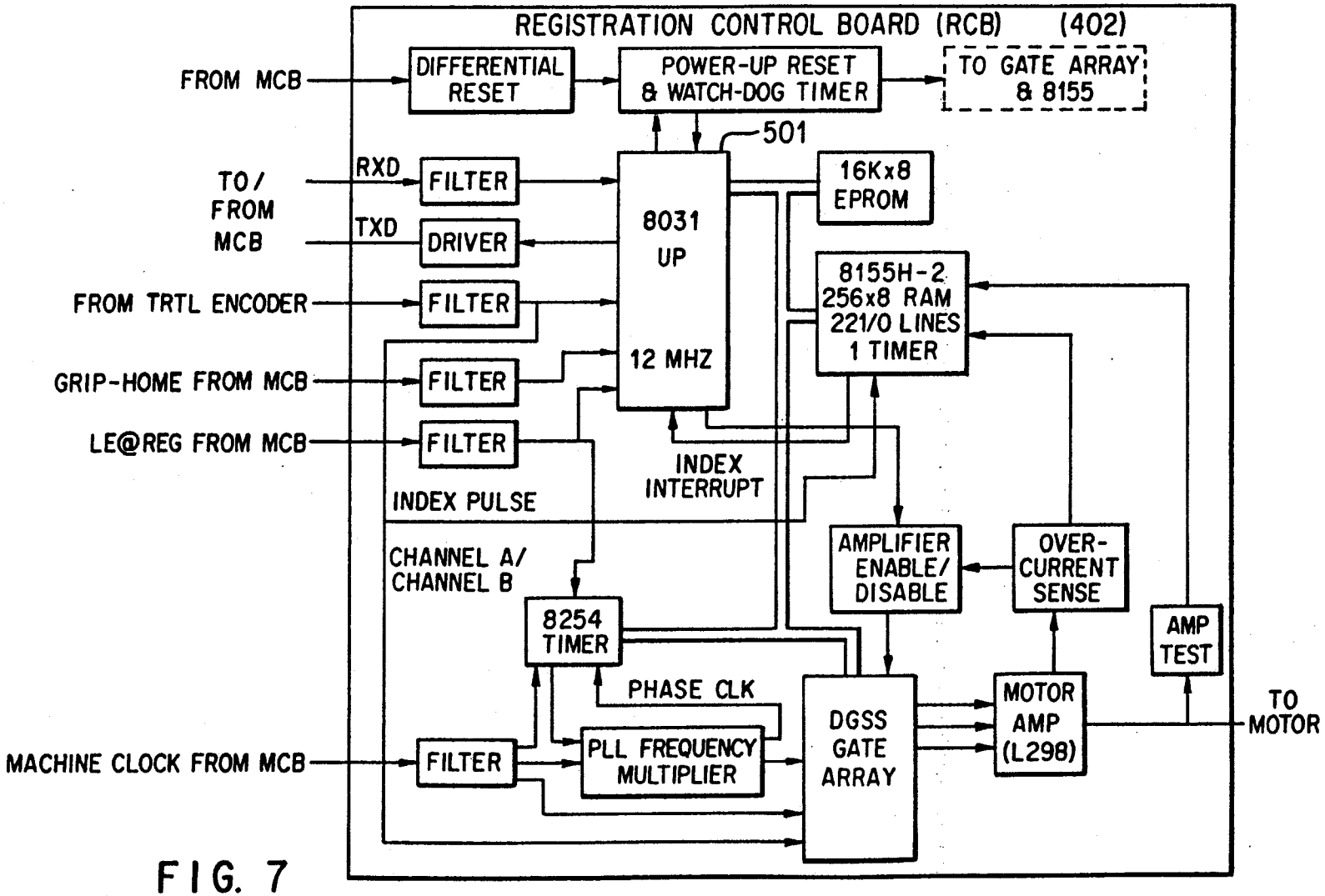
FIG. 7 is a registration control board block diagram of the present invention.

LE@REG 108 is one of the most important timing signals in the machine, and is the only electronic connection for color registration between the IIT and the IOT. LE@REG is a very accurate signal to indicate when the scan carriage has positioned itself at the lead edge of the original. Next, the image position is measured by the RCB 402 (registration control board, PWBA which controls the TRTL 404 (two roll transfer loop) motion). The machine clock 110 is a hardware encoder which is physically mounted to an idler roll on the photoreceptor module. The encoder has 500 pulses per revolution and the roll diameter is 30.2 mm. Therefore each pulse of the encoder represents 190.5 microns. A higher precision clock is generated on the RCB from the machine clock and is called the phase clock 112 (FIG. 7). The phase clock is a closed loop multiple (128x) of the 1 khz machine clock. The machine clock 110 will typically jitter $\pm 3\%$ at low frequencies and the phase clock on the RCB 402 will track the jitter up to approximately 70 hz. The phase clock therefore enables a much finer measurement of the photoreceptor position error (1.5 microns). An alternate method could utilize a very high resolution encoder to get the 1.5 micron position accuracy (63,250 lines/revolution). A high resolution encoder, however, involves a significant increase in space and cost (approximately 10 times that of a high precision phase clock).

When RCB 402 receives the first LE@REG signal, time t4 in phase clocks is stored and a counter that accumulates machine clocks is read. A counter on the RCB is constantly counting phase clocks from the rising edge of the machine clock to the next rising edge of the machine clock. When the LE@REG signal arrives, the processor (501 in FIG. 7) is interrupted to store the accumulated phase clock value, t4, i.e., the time in phase clocks between the rising edge of the machine clock and the arrival of the LE@REG signal. The first color (magenta) LE@REG is thus electronically time stamped within RCB ram variables.

The gripper bar is normally waiting in its parked position before the first LE@REG is generated. When the first LE@REG comes in, the TRTL will accelerate closed loop and then lock on to the machine clock encoder edge (integer +phase clock) that was measured when LE@REG was generated. The TRTL is thus phase locked to the photoreceptor position so that the TRTL will follow the photoreceptor motion errors to maintain accurate lead edge registration. While the TRTL is moving, the next LE@REG for the next color (cyan) will be generated by the IIT. When the TRTL receives this next LE@REG signal, the same time stamping process occurs again as described in the above paragraph in measuring t5 and t6. The RCB 402 then calculates $t7=(128-t4)+t+t6$ to determine the positional separation of the magenta to cyan latent images. At this point, the RCB knows the precise distance between the magenta and cyan images on the photoreceptor in integer machine clocks+phase clocks. When the cyan LE@REG signal comes in, the machine clock counter is read and time t5 is kept in a RCB ram variable. When the next color (yellow) LE@REG signal comes in, the machine clock counter accumulated count t8 is stored along with the phase clock count, t9. The cyan to yellow spatial separation is then calculated ($t10=(128-t5)+t8+t9$). The same measurements and calculations are then performed on any and all LE@REG signals received by the RCB.

At this point the RCB has accurate information as to the actual spatial separation of the latent images on the photoreceptor. The actual latent image separation on the photoreceptor will typically be 2000±5 machine clocks for 3 pitch mode and 3000±5 machine clocks for 2 pitch mode. Looking at one edge of one channel of the TRTL servo clock (250 pulses/motor revolution), the TRTL is exactly 3000 TRTL clocks in circumference. When running in 3 pitch mode (see FIG. 5) the RCB assumes the LE@REG to LE@REG distance is exactly 2000 machine clocks (PL3) and in 2 pitch mode (see FIG. 4) the RCB assumes the LE@REG to LE@REG distance is exactly 3000 machine clocks (PL2). When RCB 402 measures the actual pitch length (MPL) a delta position correction (DPC) is calculated by the RCB:

$$DPC=PL3-MPL \text{ (3 pitch mode)}$$

$$DPC=PL2-MPL \text{ (2 pitch mode)}$$

The RCB then uses the calculated DPC to inject a position error during the hitch. The hitch is the position correction implemented by RCB 402 to get the gripper 1 bar in the correct position corresponding to the actual latent image position for the start of the next transfer. In 2 pitch mode (11×17) the hitch amplitude is very small and occurs when the gripper bar is at 12 o'clock on the vacuum drum (see FIG. 4). If the MPL=3000 machine clocks, the TRTL will make a 2 count positive position correction. If a DPC is required, it is spread over 16 discrete time intervals spaced two millisecond apart. The RCB is designed to update the TRTL position every 2 milliseconds. The position spreading allows the RCB to make significant changes in position without going under or over speed. In the 3 pitch mode case (see FIG. 5) the hitch profile nominally makes up 1002 machine clocks of distance over 408 milliseconds. The RCB will accelerate the servo motor at 0.8 g's and reach a peak velocity of 892 mm/sec for the registration hitch. The hitch profile is a parabola to minimize power consumption. The DPC is injected starting from the peak velocity point and is spread over 16 samples during the deceleration back to process speed.

Figure 5:
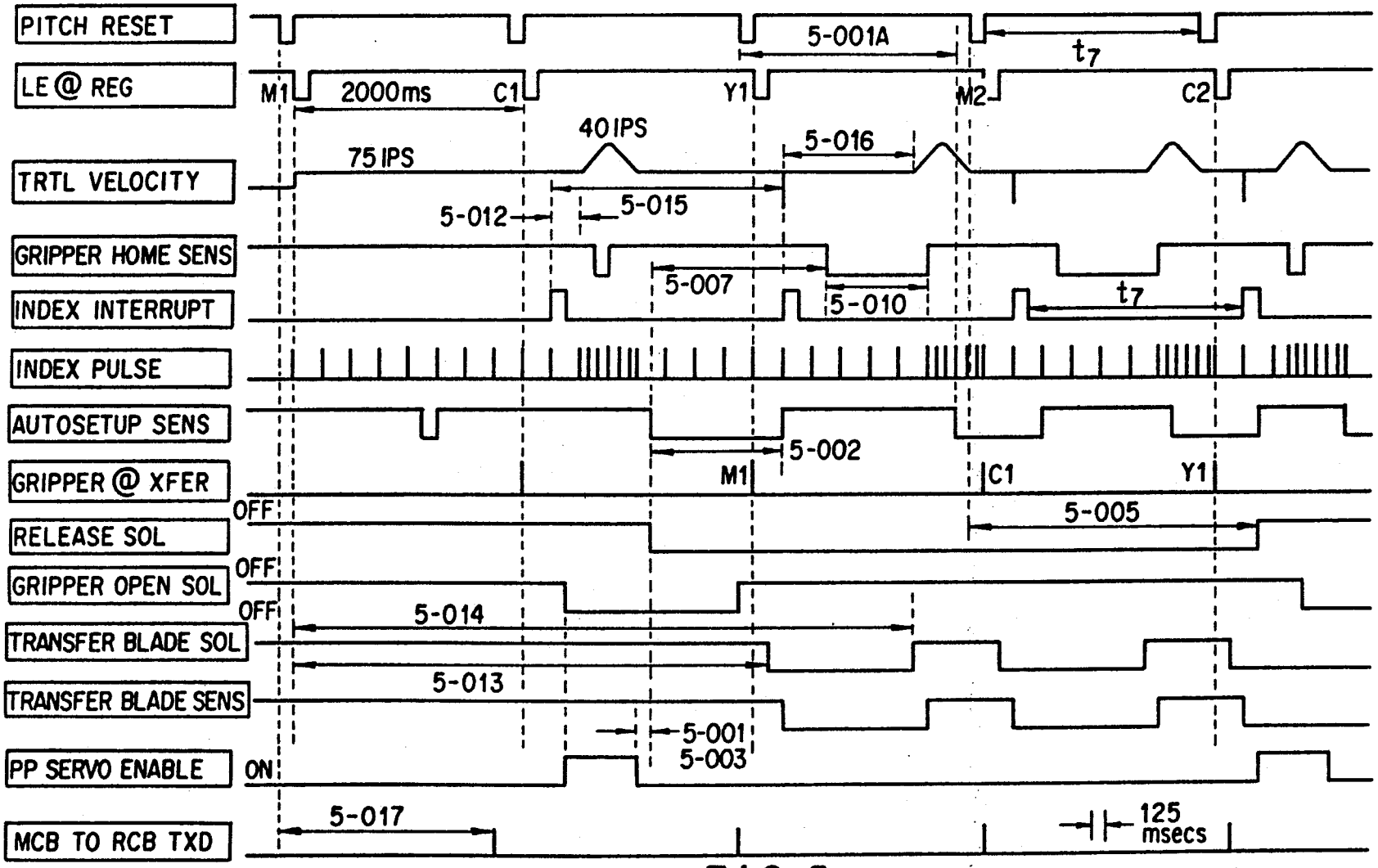
FIG. 5 depicts the two roll transfer loop timing diagram for a three pass, three pitch mode.
Figure 6:
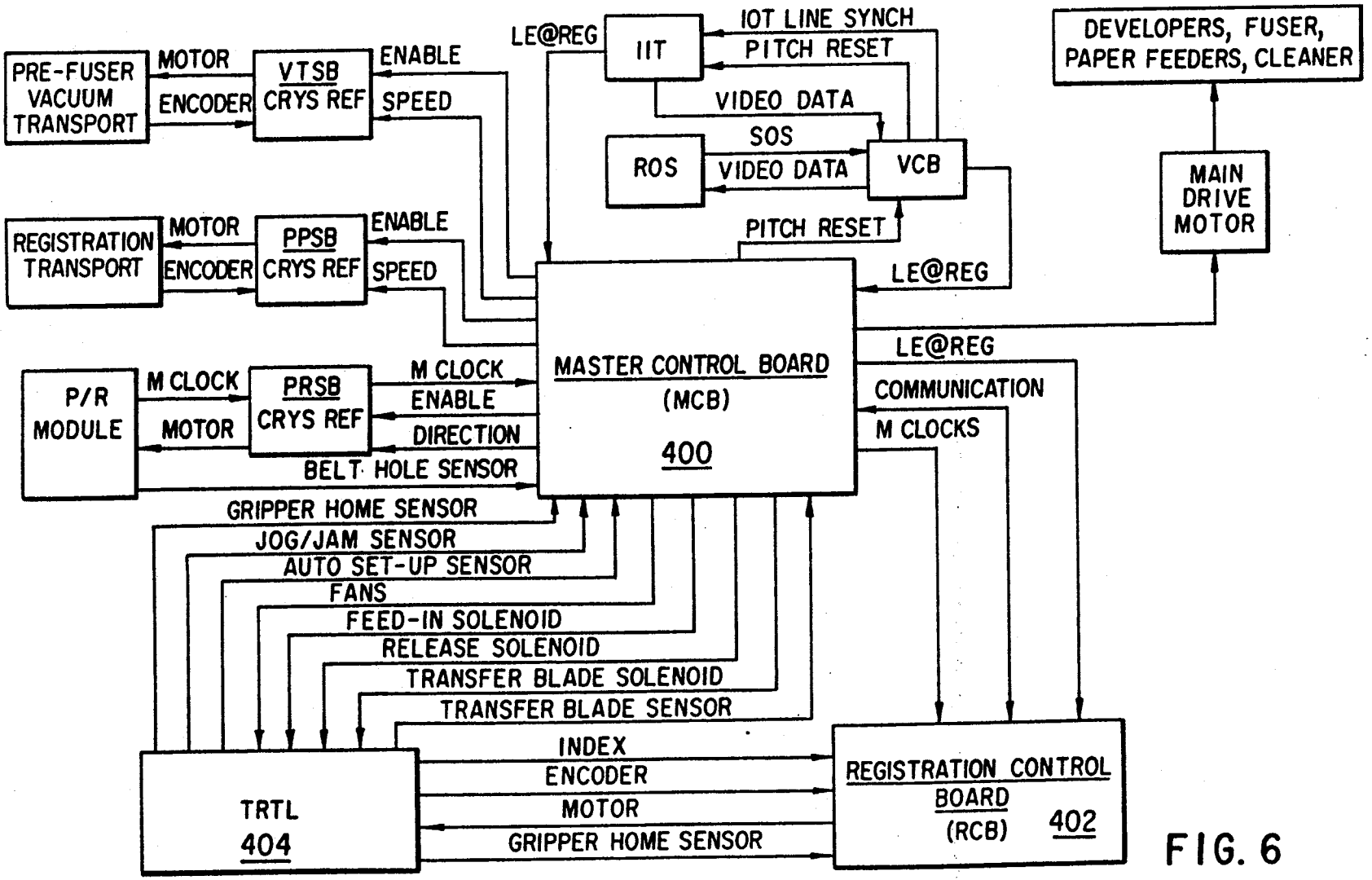
FIG. 6 is a block diagram of the motion control system for the present invention.

With the above strategy the gripper bar timing repeatability between successive transfers should be identical to the latent image separation time on the photoreceptor. Referring to FIG. 5, this means that time t7 between index interrupts will be the same time as t7 between LE@REG. With the above strategy accurate color to color registration can be achieved.

The present invention, as described by example above, provides a number of advantages, including:

(1) Loose position constraint on the imaging system (IIT) in the repeatability of the start of imaging signal due to the TRTL which tracks the image position. Costs can be lowered by using inexpensive sensors to track the photoreceptor position and less costly motion control systems for moving scan carriages.

(2) Longer photoreceptor life is enabled by imaging on multiple pitches. The invention enables a multiple pitch architecture while maintaining accurate color registration.

(3) Higher CPM for A4 long edge feed is enabled without increasing process speed and disabling longer copy sheets.

(4) Large position correction capability within the TRTL system by injecting the position corrections at the peak of the hitch.

(5) Low cost encoding technique is enabled by using a phase clock multiple of the coarse machine clock to generate a high precision phase clock used for position error measurements.

While the invention has been described with reference to particular preferred embodiments, the invention is not limited to the specific examples given, and other embodiments and modifications can be made by those skilled in the art without departing from the spirit and scope of the invention and the claims.

What is claimed is:

1. An image registration control system in a color printer for electronically synchronizing a means for recirculating paper in a loop for transfer of a plurality of colors, with a plurality of latent images on a photoreceptor surface, the control system being operable with a pitch mode of at least two, comprising:

a) means for generating a belt hole signal corresponding to a seam on the photoreceptor surface;

b) means for generating a pitch reset at a time $t_1$, for partitioning the belt into at least two segments in response to said belt hole signal;

c) means for generating a first reference signal at a time $t_2$ based on a first number of time signals, each time signal corresponding to the printing of a scan line of a latent image, said first number of time signals counted between said pitch reset and a scan start signal;

d) means for generating a second reference signal at a time $t_3$ after time $t_2$ based on a second number of time signals corresponding to the printing of each scan line, said second number of time signals counted between said pitch reset and the arrival of a scanner at a lead edge of an original document to be scanned;

e) means for measuring an actual pitch length corresponding to one latent image of the plurality of latent images on the photoreceptor based on a measurement in phase clocks at a time $t_4$ of the phase position of said second reference signal at time $t_3$ with respect to a machine clock;

f) means for repeatedly actuating said means for generating a second reference signal and said means for measuring an actual pitch length according to the pitch mode to determine a pitch length for each subsequent latent image of the plurality of latent images;

g) means for measuring the spatial separation of the plurality of latent images on the photoreceptor as a function of the pitch length and first and second reference signals measured for each latent image;

h) means for assuming a pitch length for each latent image;

i) means for correcting a position of said means for recirculating relative to each latent image based on a difference between said actual and assumed corresponding measured pitch lengths;

wherein at said reference signal $t_3$, said means for recirculating is locked onto the machine clock encoder edge such that the means for recirculating is phase locked onto the photoreceptor position so that a timing repeatability of the means for recirculating between successive transfers is identical to said latent image separation.

2. An image registration control system in a color printer for synchronizing the placement of at least two latent images on a photoreceptor surface with the movement of a paper transfer loop, the registration control system comprising:

means for electronically partitioning the photoreceptor surface into at least two pitches corresponding to said at least two latent images;

means for scanning an original document;

means for applying said at least two latent images onto the photoreceptor surface corresponding to scanned color images of the original document;

means for electronically signaling when said means for scanning arrives at a lead edge of the original document for each scan; and means for electronically synchronizing the movement of a paper transfer loop in response to each electronic signal.

3. The image registration control system of claim 2, further comprising:

means for measuring the length of each latent image on said photoreceptor;

means for measuring the spatial separation of each latent image;

means for moving said paper transfer loop in accordance with an assumed pitch length;

means for correcting the movement of said paper transfer loop in response to said measured length of each latent image and said spatial separation.

4. The image registration control system of claim 2, further comprising means for generating a belt hole signal corresponding to a seam on the photoreceptor surface; wherein said means for electronically partitioning the photoreceptor surface partitions the surface in response to the belt hole signal.

5. The image registration control system of claim 2, wherein said means for electronically partitioning partitions the photoreceptor surface into 2 or 3 pitches.

6. The image registration control system of claim 2, further comprising timing means for timing when each electronic signal is emitted corresponding to the arrival of the scanning means at a lead edge of the original for each scan.

7. The image registration control system of claim 6, wherein said timing means is a machine clock hardware encoder mounted on an idler roll for entrainment of the photoreceptor surface.

8. The image registration control system of claim 7, further comprising a phase clock closed loop multiple of the machine clock for generating a higher precision time.

9. The image registration control system of claim 6, further comprising a storing means for storing each measured time when each lead edge signal is emitted for each scan.

10. The image registration control system of claim 9, wherein said means for electronically synchronizing the movement of the paper transfer loop comprises:

means for locking the movement of said paper transfer loop to each time measured and stored when each lead edge signal is emitted, such that paper transfer loop is phase locked to the position of the photoreceptor surface for each scan.

11. The image registration control system of claim 10, further comprising:

means for assuming a latent image spatial separation between the latent images depending upon the pitch mode;

means for moving said paper transfer loop in accordance with the assumed latent image spatial separation; and means for correcting the movement of the paper transfer loop based on the difference between the assumed spatial separation and the actual spatial separation based on the timing between each lead edge signal.

12. A method for image registration control in a color printer for synchronizing the placement of at least two latent images on a photoreceptor surface with the movement of a paper transfer loop, the method comprising the steps of:

electronically partitioning the photoreceptor surface into at least two pitches corresponding to said at least two latent images;

scanning an original document with a scanner;

applying said at least two latent images onto the photoreceptor surface corresponding to scanned color images of the original document;

electronically signaling when the scanner arrives at a lead edge of the original document for each scan; and electronically synchronizing the movement of a paper transfer loop in response to each electronic signal.

13. The method of claim 12, further comprising the steps of:

measuring the length of each latent image on said photoreceptor;

measuring the spatial separation of each latent image;

moving said paper transfer loop in accordance with an assumed pitch length;

correcting the movement of said paper transfer loop in response to said measured length of each latent image and said spatial separation.

14. The method of claim 12, further comprising the step of:

generating a belt hole signal corresponding the photoreceptor surface; wherein in the step of electronically partitioning the photoreceptor surface, the surface is partitioned in response to the belt hole signal.

15. The method of claim 12, wherein the photoreceptor surface is partitioned into 2 or 3 pitches.

16. The method of claim 12, comprising the step of timing when each electronic signal is emitted corresponding to the arrival of the scanner at a lead edge of the original for each scan.

17. The method of claim 16, wherein the timing is performed by a machine clock hardware encoder mounted on an idler roll for entrainment of the photoreceptor surface.

18. The method of claim 17, further comprising a phase clock closed loop multiply of the machine clock time for generating a higher precision time.

19. The method of claim 16, further comprising the step of storing each measured time when each lead edge signal is emitted for each scan.

20. The method of claim 19, wherein the step of electronically synchronizing the movement of the paper transfer loop comprises:

locking the movement of said paper transfer loop onto each time measured and stored when each lead edge signal is emitted, such that paper transfer loop is phase locked to the position of the photoreceptor surface for each scan.

21. The method of claim 20, further comprising the steps of:

assuming a latent image spatial separation between the latent images depending upon the pitch mode;

moving said paper transfer loop in accordance with the assumed latent image spatial separation; and correcting the movement of the paper transfer loop based on the difference between the assumed spatial separation and the actual spatial separation, the actual spatial separation based on the timing between each lead edge signal.

* * * * *